US010689813B2

(12) United States Patent
Pedretti

(10) Patent No.: US 10,689,813 B2
(45) Date of Patent: Jun. 23, 2020

(54) PNEUMATIC STRUCTURAL ELEMENT

(71) Applicant: PIBRIDGE LTD, Lugano (CH)

(72) Inventor: Mauro Pedretti, Biasca (CH)

(73) Assignee: PIBRIDGE LTD, Lugano (CH)

( * ) Notice: Subject to any disclaimer, the term of this patent is extended or adjusted under 35 U.S.C. 154(b) by 0 days.

(21) Appl. No.: 16/307,255

(22) PCT Filed: Jun. 1, 2017

(86) PCT No.: PCT/CH2017/000053

§ 371 (c)(1),
(2) Date: Dec. 5, 2018

(87) PCT Pub. No.: WO2017/210803

PCT Pub. Date: Dec. 14, 2017

(65) Prior Publication Data

US 2019/0301112 A1 Oct. 3, 2019

(30) Foreign Application Priority Data

Jun. 8, 2016 (CH) ..... 728/16

(51) Int. Cl.

| | |
|---|---|
| ***E01D 15/12*** | (2006.01) |
| ***E01D 15/20*** | (2006.01) |
| ***E04C 3/00*** | (2006.01) |
| ***E01D 12/00*** | (2006.01) |

(Continued)

(52) U.S. Cl.

CPC ..... *E01D 15/122* (2013.01); *E01D 12/00* (2013.01); *E01D 15/20* (2013.01); *E04C 3/005* (2013.01);

(Continued)

(58) Field of Classification Search

CPC ..... E01D 15/122; E01D 12/00; E01D 15/20; E04C 3/005; E04C 3/46; E04H 15/20; E04H 2015/201

(Continued)

(56) References Cited

U.S. PATENT DOCUMENTS 5,414,886 A * 5/1995 Sust ..... E01D 19/005 14/2.5
10,174,466 B2 * 1/2019 Pedretti ..... E04C 3/005

(Continued)

FOREIGN PATENT DOCUMENTS

WO WO-01/73245 A1 10/2001
WO WO2004083569 * 3/2004 ..... E04H 15/20

(Continued)

OTHER PUBLICATIONS

International Search Report; dated Jul. 31, 2017; Authorized Officer—Marlon Schnedler; 3 pages.

*Primary Examiner* — Raymond W Addie
(74) *Attorney, Agent, or Firm* — Winstead PC

(57) ABSTRACT

The pneumatic support has a pneumatic body which can be placed pneumatically under pressure and which, under operating pressure, operationally keeps at a distance apart a compression member which extends substantially over its length and a tension member which likewise extends substantially over its length, wherein forces are introduced at force introduction points in end regions of the compression member and the tension member into said members and wherein connecting elements are provided between the compression member and the tension member and introduce forces into the compression member and the tension member likewise at force introduction points, wherein, furthermore, the pneumatic body has formations which extend between adjacent force introduction points and which project outwardly beyond a rectilinear connection between the adjacent force introduction points. As a result, undesired distortion of the support under operating pressure, but without operating load, is avoided.

13 Claims, 5 Drawing Sheets

(51) Int. Cl.
*E04C 3/46* (2006.01)
*E04H 15/20* (2006.01)

(52) U.S. Cl.
CPC ..... *E04C 3/46* (2013.01); *E04H 15/20* (2013.01); *E04H 2015/201* (2013.01)

(58) Field of Classification Search
USPC ..... 14/1–69.5, 72.5–78
See application file for complete search history.

(56) References Cited

U.S. PATENT DOCUMENTS

2004/0237225 A1* 12/2004 To ..... E01D 15/122 14/73.5
2010/0139016 A1* 6/2010 Miettinen ..... E01D 1/00 14/77.1
2010/0146868 A1* 6/2010 Lukasiewicz ..... E04H 15/18 52/2.11
2010/0224320 A1* 9/2010 Tsai ..... G02F 1/1303 156/707
2010/0307071 A1* 12/2010 Luchsinger ..... E04C 3/005 52/2.11
2011/0252716 A1* 10/2011 Pedretti ..... E01D 15/122 52/2.13

FOREIGN PATENT DOCUMENTS

WO WO-2005/007991 A1 1/2005
WO WO-2005042880 A1 5/2005
WO WO-2009/065238 A2 5/2009
WO WO-2015/176192 A1 11/2015

* cited by examiner

PNEUMATIC STRUCTURAL ELEMENT

The present invention relates to a pneumatic support according to the preamble of Claim 1 and to a method for the production thereof according to Claim 10.

Pneumatic supports of the type mentioned are known and are based on a cylindrical basic shape according to WO 01/73245. This basic shape has been developed into, inter alia, a spindle-shaped support according to WO 2005/007991.

An advantage of such pneumatic supports is their low weight and the extremely small transport volume, since the inflatable body can be folded up and the tension members can be in the form of cables. A disadvantage of such pneumatic supports consists in that, although they can bear high distributed loads and are therefore suitable for many purposes, they are suitable to only a limited extent for asymmetric loads in comparison with the possible distributed load, which in particular prevents use as a bridge, since an axle rolling over a bridge, for instance of a heavy goods vehicle, represents a particularly unfavourable case in this respect.

Figure 1A:
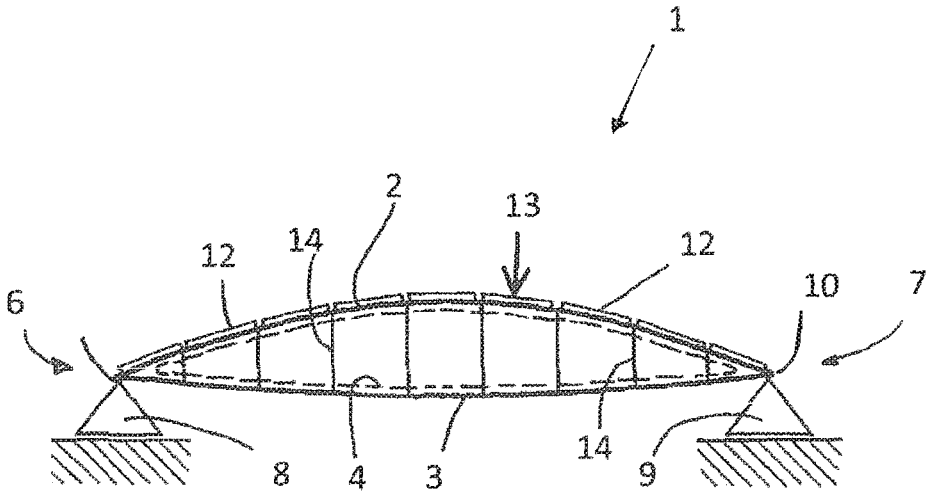
Fig 1a Prior Art

FIGS. 1*a* to 1*d* show by way of example and schematically pneumatic supports according to the prior art, which are shown with exaggerated thickness for the sake of clarity. FIG. 1*a* shows a pneumatic support 1 according to WO 2005/042880, having a compression member 2, a tension member 3 and an inflatable pneumatic body 4 which is arranged between the compression member 2 and the tension member 3 and is inflated to operating pressure and thus holds the compression member 2 and the tension member 3 apart.

The pneumatic body 4 preferably consists of a gas-tight, flexible, substantially non-elastic material which forms a sleeve which can be collapsed for transport and assumes a shape suitable for the pneumatic support in question when under operating pressure.

The support 1 is supported at its ends 6, 7 via rests 8, 9; the compression member 2 and the tension member 3 are also connected to each other there via a node 10, 11. Schematically indicated planking 12 allows the support 1 to be used in this case as a bridge.

The following conceptual model can explain the operating principle of the support:

If a load 13 acts on the planking 11 and thus on the compression member 2, the latter is borne by the inflated body 4 under operating pressure, which body for its part, however, rests on the tension member 3 which thus actually bears the load 13. As a result, the tension member 3 tries to move downwards, which is not possible, however, since the compression member 2 holds apart the common end nodes 10 and 11 and thus also the end of the tension member 3. End nodes 10, 11 mean the regions in which the compression member 2 and the tension member 3 are connected to each other for operation. By means of the end nodes 10, 11, force is transmitted from the compression member 2 into the tension member 3, and conversely force is also transmitted from the tension member 3 into the compression member 2. The end nodes 10, 11 are therefore force introduction points for both the compression member 2 and the tension member 3.

As a result, the tension member 3 is loaded substantially only with axial tension, and the compression member 2 is loaded substantially only with axial compression, and therefore the tension member 3 can be in the form of a cable and the compression member 2 can be in the form of a thin rod. However, a thin rod under compression is susceptible to buckling, and therefore the buckling limit of the compression member 2 determines the load capacity of the support 1.

In the case of a distributed load which is distributed symmetrically over the length of the support, as is the case in roof structures, for instance, a reduced risk of buckling results, since buckling in a direction counter to the application of load is prevented by the load itself, and buckling in the loading direction is prevented by the compression member resting on the pneumatic body 4.

In the case of an asymmetrical load, however, the compression member sinks into the body 4 more at the location of the load 12 and protrudes at a different point, with a tendency to protrude beyond the rest surface on the body 4 and thus lift off from said body, which results in an increased risk of buckling and thus in a significantly reduced load capacity of the support 1.

Therefore, connecting elements are preferably arranged vertically (i.e. in the loading direction and perpendicular to the longitudinal axis of the support 1), said connecting elements being in the form of simple tension members 14 which connect the compression member 2 to the tension member 3. In the case of an asymmetrical load, the tension members 14 are suitable, to a certain extent, for preventing the compression member 2 from lifting off from the body 4 at an unloaded location and thus buckling. The horizontal spacing of the tension members 14 can be optimised to the specific case by a person skilled in the art.

The connecting points between the tension members 14 and the compression member 2 and the tension member 3 are again force introduction points for these elements.

Figure 1B:
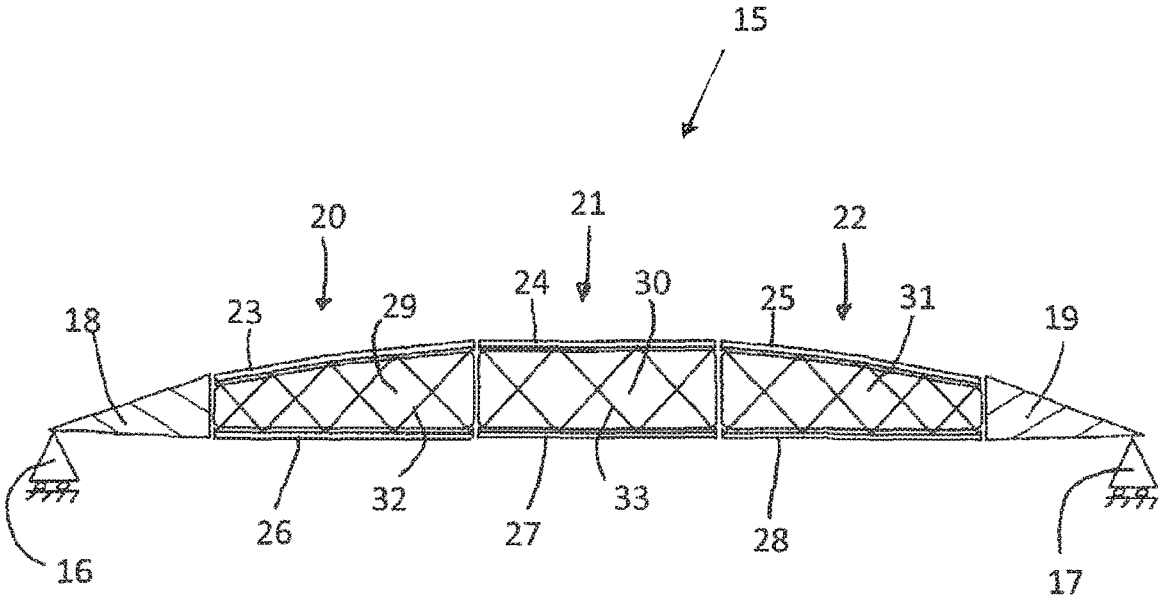
Fig 1b Prior Art

FIG. 1*b* shows a pneumatic support 15 according to WO 2015/176192, which likewise rests on rests 16, 17 and has two end nodes in the form of ramp-like sills 18, 19 and three pneumatic segments 20 to 22, each of the pneumatic segments having a compression member 23 to 25, for example in the form of a compression rod, a tension member 26 to 28, in this case for example in the form of a tension rod (a tension cable would also be possible), and a pneumatic body 29 to 31, each pneumatic body 29 to 31 again holding apart the associated compression member 23 to 25 and the associated tension member 26 to 28 for operation. By means of two connecting elements 32, 33 which run in a zigzag manner at an angle of preferably 45° without gaps through each segment 20 to 22 (and thus without gaps through the pneumatic support 15 formed by the arrangement shown), a structure is formed which is particularly suitable for asymmetrical loads and is rigid, i.e. bends downwards from the straight (unloaded) desired position when under operating load only to an insignificant extent in comparison with the support of FIG. 1*a*.

In this case too, the connecting points of the nodes 18, 19 with the respective compression member 23, 25, tension member 26, 28 and the connecting points of the compression members 23 to 25 and of the tension members 26 to 28 with the connecting elements 32, 33 form force introduction points into the compression members 23 to 25 and into the tension members 26 to 28.

Figure 1C:
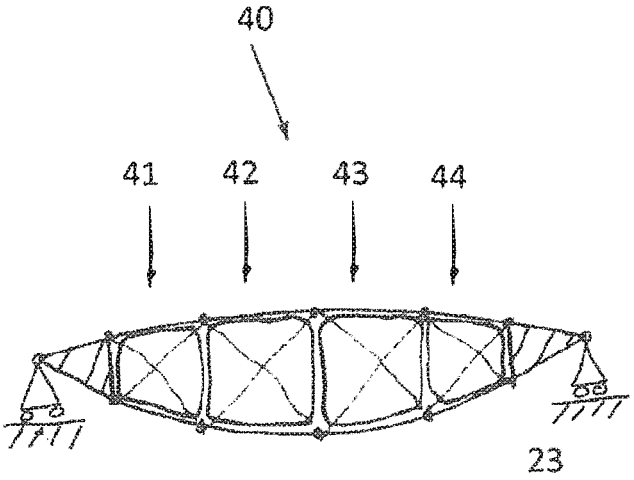
Fig 1c Prior Art

FIG. 1*c* shows a support 40, likewise according to WO 2015/176192, which is constructed analogously to the support 15 of FIG. 1*b*, in this case has four pneumatic segments 41 to 44 and has a modified longitudinal cross-section, i.e. an only slightly convex upper face and a very convex lower face.

Figure 1D:
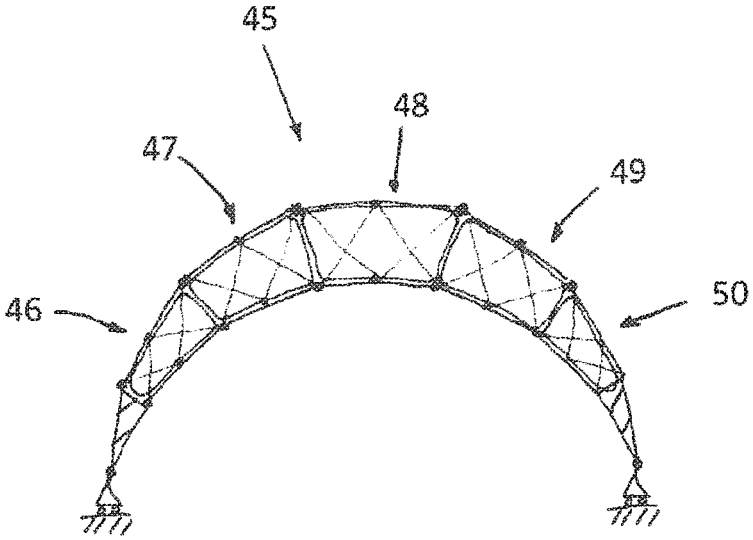
Fig 1d Prior Art

FIG. 1*d* shows a support 45, likewise having multiple pneumatic segments 46 to 50, having a further modified longitudinal cross-section such that it can be loaded in the manner of an arch.

Common to the supports 1, 15, 40, 45 is the advantage that they can be transported easily when dismantled and can be assembled on site in that the end nodes, compression members, tension members and any connecting elements are assembled, then the pneumatic bodies are inflated and put under operating pressure. A disadvantage is that the supports 1, 15, 40, 45 become increasingly distorted during pressure buildup and finally, when under operating pressure but free of load, assume a position distorted in an arcuate manner, and only assume their extended desired position as shown in FIGS. 1*a* to 1*d* when under load, and finally bend, to a great extent in the case of a support 15 as in FIG. 1*a*, and to a reduced extent in the case of a support 15, 40, 45 as in FIGS. 1*b* to 1*d*, when under operating load.

The distortion (i.e. the undesired deformation which occurs when the pneumatic bodies 4 and 29-31 are inflated without load) takes place in the direction of the greater curvature of the compression member and of the tension member, and therefore the supports of FIGS. 1*a*, 1*b* and 1*d* curve upwards and the support according to FIG. 1*c* is distorted downwards without load. As a result, the end nodes move towards each other in the load-free state, which is undesirable.

FIGS. 1*e* to 1*h* schematically show the distortion of the supports 1, 15, 40 and 45 using the longitudinal centre lines thereof, the dashed longitudinal centre lines 55 to 58 corresponding to the desired position as shown in FIGS. 1*a* to 1*d*. The extended centre lines 59 to 62 corresponding to the actual position under operating pressure but without load (i.e. corresponding to the distortion) are shown extrapolated and only qualitatively. The dash-dotted longitudinal centre lines 58 to 61 correspond to the actual position under operating pressure and operating load, i.e. the load deformation; for the sake of simplicity, a load (not shown in the figure) acting in the centre of the support 1, 15, 40 and 45 is assumed.

Figure 1E:
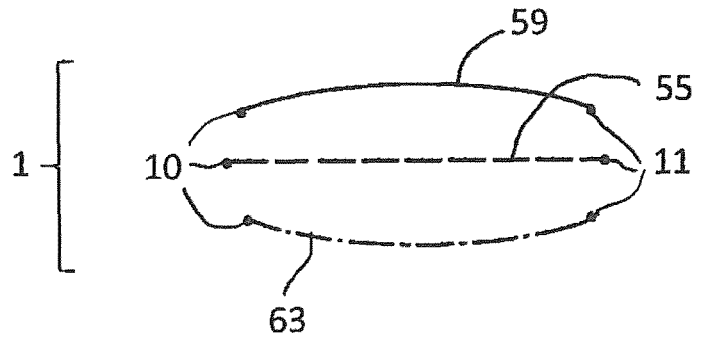
Figure 1F:
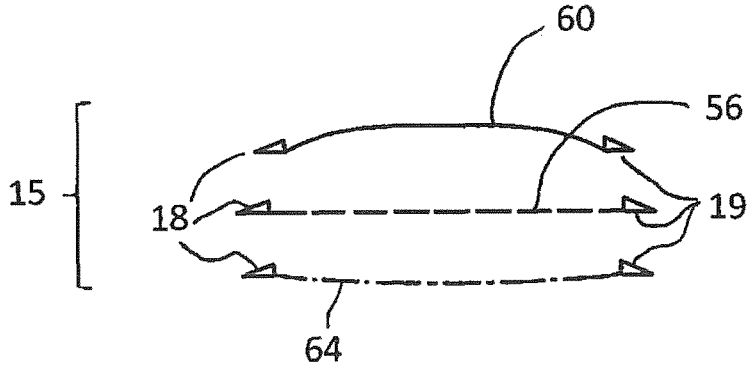

It can be seen from FIG. 1*e* that the pneumatic support 1 shown in FIG. 1*a* has comparatively great distortion and also comparatively great bending under load. The total displacement of the longitudinal centre line is too great for many applications.

It can be seen from Figure if that the pneumatic support 15 shown in FIG. 1*b* has moderate distortion and also only minor, insignificant bending under load. The only moderate curvature is attributable to the fact that the central segment 21 (FIG. 1*b*) is symmetrical to its longitudinal centre line, that is, substantially is not distorted (except for an asymmetry owing to, for example, manufacturing tolerances).

Figure 1G:
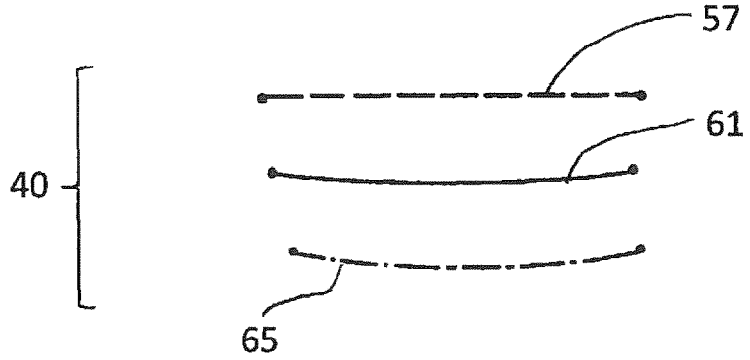

It can be seen from FIG. 1*g* that the pneumatic support 40 shown in FIG. 1*c* has comparatively great downward distortion and also comparatively great bending under load.

It can be seen from Figure if that the pneumatic support 451 shown in FIG. 1*d* has a comparatively large distortion but little bending under load.

Figure 1H:
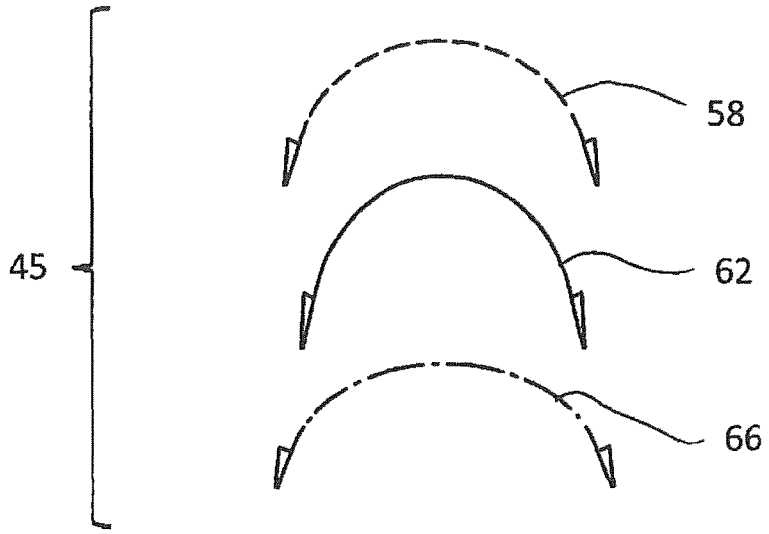

The above-discussed conditions for a support according to FIG. 1*d* can be seen in FIG. 1*h*.

Distortion and bending play or do not play a role depending on the intended use: for example, distortion is unfavourable in the case of a bridge, which should be as resistant to bending as possible. It is particularly disadvantageous if a bridge formed from supports according to FIG. 1*b* were exceptionally resistant to bending and thus suitable for use but, owing to the distortion, is steep to drive on at the ends and then behaves in a spongy/soft manner up to its desired position (line 18 of FIG. 1*f*). The advantage of the bending resistance only applies to a reduced extent.

This also applies to other pneumatic supports, for example according to FIGS. 1*a* to 1*h*, depending on the intended use.

Correspondingly, the object of the present invention is to create a pneumatic support which exhibits the phenomenon of distortion only to a reduced extent or avoids it altogether.

The object is achieved by the characterising features of Claims 1 and 10.

The fact that the pneumatic body has formations which extend between adjacent force introduction points and which project outwardly beyond a rectilinear connection between the adjacent force introduction points means that a pressure distribution is produced in the pneumatic body (or in the pneumatic bodies of the segments of a pneumatic support having multiple segments) which counteracts and thereby reduces or avoids distortion.

The invention is explained in more detail further below using the figures.

Figure 2:
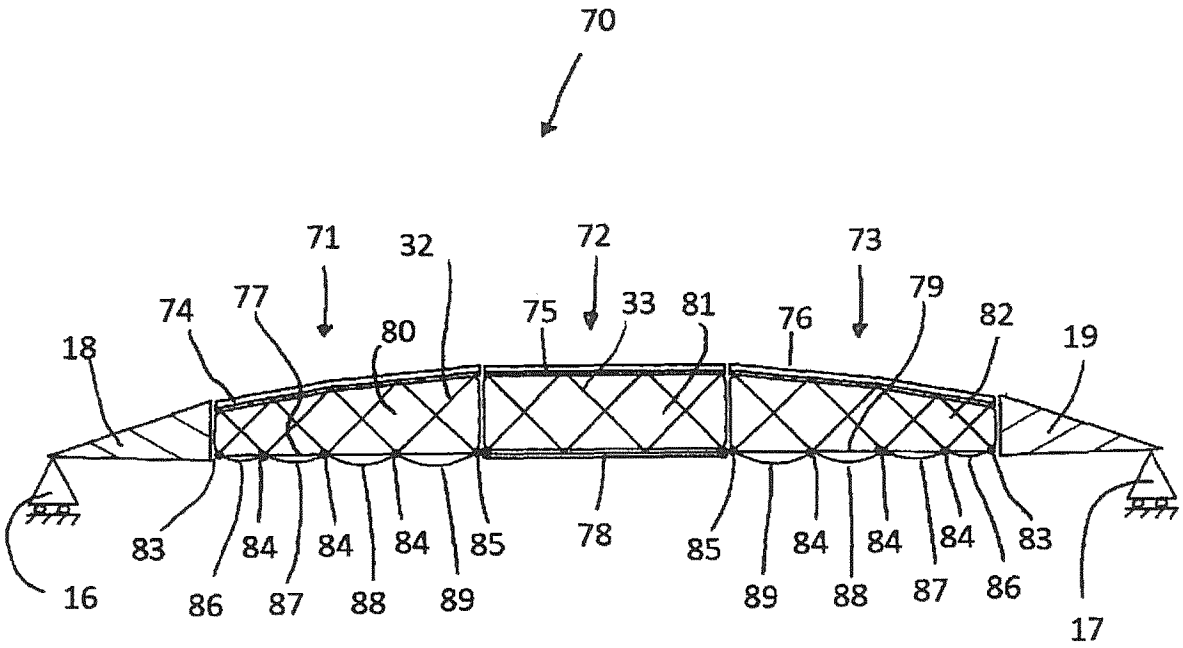

In the figures:

FIGS. 1*a* to 1*d* schematically show pneumatic supports according to the prior art, FIGS. 1*e* to 1*h* schematically show the distortion of the pneumatic supports under load-free operating pressure, under operating pressure and operating load, and in a desired position without distortion, FIG. 2 schematically shows a pneumatic support designed according to the invention.

FIG. 2 shows an embodiment according to the invention of a pneumatic support 70 which is constructed analogously to the support 15 having three segments 20 to 22 as shown in FIG. 1*b*. The segments 71 to 73 can be seen, the segments 71 and 73 being modified and the segment 72 corresponding in structure to the segment 21 of the support 15 (FIG. 1*b*).

It should be noted at this point that in principle any type of pneumatic support exhibiting the phenomenon of distortion can be modified according to the invention.

Shown are the compression rods 74 to 76 and the tension elements in the form of tension cables 77, 79 and the tension rod 78 of the segments 71 to 73. Also shown are the connecting elements 33, 34 which are unchanged in comparison with the embodiment of FIG. 1*b* and reinforce the pneumatic support 70 under operating load. Likewise unchanged in comparison with the embodiment of FIG. 1*b* is the pneumatic body 81, while the pneumatic bodies 80, 82 are modified according to the invention, as described below.

FIG. 2 also shows the force introduction points 83, 84 and 85 present in the segments 71, 73, the force introduction points 83 connecting the connecting element 33, the sill 18 and the tension cable 77 to one another and thus introducing the corresponding forces into the tension cable 77. The force introduction points 85 connect the tension rod 78, the connecting element 33 or 34 and the tension cable 77, as a result of which the corresponding forces are introduced into the tension cable 77. The force introduction points 84 connect the tension cable 77 to the connecting elements 32, 33 and introduce the corresponding forces into the tension cable 77. Formations 86 to 89 are provided between adjacent force introduction points 83, 84 or 84, 84 and 84, 85 in the pneumatic bodies 80, 82, said formations being provided on the side of the tension member in the embodiment of FIG. 2.

Thanks to these formations 86 to 89, a force equilibrium is produced according to the invention in the pneumatic bodies 80, 82 by the operating pressure, with which force equilibrium deformation of the pneumatic body by the operating pressure is substantially omitted, in contrast to the prior art. Formations 86 to 89 are advantageously, and preferably as shown in FIG. 2, arcuate, very preferably circular arc-shaped, and extend from one force introduction point 83 to 85 to the adjacent force introduction point 84.

Further preferably, the formations 86 to 89 have a height above the connection line between the force introduction points 83 to 85 delimiting them of 10 to 15% of the spacing of these force introduction points 83 to 85. The applicant has found that such a height already effectively prevents the undesirable distortion.

Finally, the tension member 77, 79 is further preferably operatively connected to the pneumatic body 80, 82 only at the location of the force introduction points 83 to 85, so that the tension member between the force introduction points 83 to 85 can extend rectilinearly and do not have to follow the contour of the pneumatic body 80, 82 or of the contour of the formations 86 to 89, which results in a shortening of the spacing of the force introduction points 83, 85 under operating pressure, and then results in a more complicated design of the whole segment 71, 73 in relation to the compression rod 74, 76, the pressure body 80, 82, the tension cable 77, 79 and the contour of the formations 86 to 89, which is very complex to calculate and therefore would have to be determined by experiments as well.

According to the preferred embodiment shown in the figure, a pneumatic support (having one or more asymmetrical pneumatic bodies in the longitudinal direction) is produced, in which, when under operating pressure but load-free, the side thereof with the compression member is at least partially curved in an arcuate manner, and the side thereof with the tension member is designed such that the force introduction points thereof lie substantially on a straight line.

It should be mentioned at this point that the configuration of the pneumatic support according to FIG. 2 can of course be modified, for example by omitting the central segment, so that the side with the compression member is curved in a continuously arcuate manner. In a simulation, the applicant determined the distortion of a 38 m-long pneumatic support for an operating load of 4.5 t with a continuously arcuate compression member and a straight tension member (such a configuration should be particularly favourable for construction in the field, since the tension member or the lower face of the pneumatic support then lies on the ground). However, the distortion results in a "hump" in the support with a height of approx. 1 metre, the tension member in the centre of the support lifting off from the ground to approximately the same height. However, the pneumatic support provided with formations according to the invention and otherwise having the same configuration as the support from the prior art was substantially free of distortion, which was only in the region of approx. 10 cm.

In summary, a pneumatic support is produced according to the invention having a (or multiple) pneumatic body which can be placed pneumatically under pressure and which, under operating pressure, operationally keeps at a distance apart a compression member which extends substantially over its length and a tension member which likewise extends substantially over its length, wherein forces are introduced at force introduction points in end regions of the compression member and the tension member into said members and wherein connecting elements are provided between the compression member and the tension member and introduce forces into the compression member and the tension member likewise at force introduction points, wherein the pneumatic body has formations which extend between adjacent force introduction points and which project outwardly beyond a rectilinear connection between the adjacent force introduction points.

As already mentioned above, the pneumatic support preferably has a flexible sleeve (specifically the pneumatic body or, in the case of multiple segments, multiple pneumatic bodies having multiple flexible sleeves), the pattern of which defines the shape of the support under operating pressure such that the formations are formed in a predefined contour.

There is preferably at least one connecting element in the pneumatic support, said connecting element extending in a zigzag manner continuously through the entire length of the pneumatic body and particularly preferably running, as mentioned above, at an angle of 45° to the intended loading direction (therefore, 45° to the horizontal in the case of a bridge). Therefore, the adjacent force introduction points have different spacings from one another when the spacing of the compression member and the tension member changes, as is the case in the embodiment according to FIG. 2 in the segments 71, 73 or generally in pressure bodies formed asymmetrically over a length. The formations 86 to 89 thereby have different heights, since this height is preferably defined in relation to the spacing of the associated force introduction points.

In a particularly simple manner, the height of the formations is defined iteratively, since the calculation for this is complex: In a first step, the height is defined at 10 to 15% of the spacing of the associated (i.e. adjacent) force introduction points. Then, the pneumatic support can still have an undesirable residual distortion, and therefore the height of the formations is increased further by 30-50% in a second step (with an initial 10% increase, the resulting height would then be between 13 and 15% of the spacing of the adjacent force introduction points). With most configurations of a pneumatic support to be defined for the specific case by a person skilled in the art, this iterative method converges very rapidly but can easily be continued until the distortion substantially disappears or no further improvement occurs for the intended use of the support.

Specifically, a method is provided according to the invention with which arcuate, preferably circular arc-shaped, formations are preferably provided in a pneumatic support, the height of which formations being 10 to 15% of the spacing of the associated force introduction points.

Therefore, the structure of a pneumatic support according to the invention is preferably designed such that a (or multiple) formation has a height above the connecting line between the force introduction points delimiting them of 10 to 15% of the spacing of these force introduction points.

The pneumatic support designed according to the invention is then constructed for the case of the application of the iterative method, and the pneumatic body of the support is brought to operating pressure and checked for the presence of a persistent distortion of the support relative to the intended shape, and in the positive case the height of selected formations is increased by 30-50%. Usually, a person skilled in the art will increase all the formations equally but can change only selected formations, for example by experimentation, if the affected pneumatic body has a particular shape.

Finally, if desired for the intended use of the pneumatic support, the iterative method can be continued, i.e. the height of the formations can be increased iteratively until a further increase does not produce a further improvement in the curvature of the unloaded support.

As a result, a method is provided according to the invention for producing a pneumatic support, in which the shape of the pneumatic support during operation and the location of the force introduction points are defined in advance and then the distortion to be expected under operating pressure but without operating load is defined, and then formations on the inside of the curve of the pneumatic support are provided, said formations extending outwardly from force introduction point to force introduction point via a connecting line between associated force introduction points.

The invention claimed is:

1. A pneumatic support comprising:

a pneumatic body which can be placed pneumatically under pressure and which, under an operating pressure, operatively keeps a compression member which extends substantially over a length of the pneumatic body a distance apart from a tension member which likewise extends substantially over the length of the pneumatic body, wherein forces are introduced at force introduction points in end regions of the compression member and the tension member into said compression member and tension member connecting elements are provided between the compression member and the tension member that introduce forces into the compression member and the tension member likewise at force introduction points, wherein, the pneumatic body has formations which extend between adjacent force introduction points and which project outwardly beyond a rectilinear connection between the adjacent force introduction points.

2. The pneumatic body according to claim 1, wherein the formations are provided on the side of the tension member.

3. The pneumatic support according to claim 1, wherein:

the formations are designed such that the pneumatic support curves less during buildup of the operating pressure in the pneumatic body than if formations were not present, and the deflection of the support resulting from the curvature is preferably less than 30 of the deflection without formations.

4. The pneumatic support according to claim 1, wherein the connecting element extends in a zigzag manner continuously through an entire length of the pneumatic body.

5. The pneumatic support according to claim 1, wherein:

the pneumatic support has a flexible sleeve, and the pattern of the flexible sleeve defines the shape of the support under operating pressure such that the formations are formed in a predefined contour.

6. The pneumatic support according to claim 1, wherein the formations are arcuate and extend from one force introduction point to the adjacent force introduction point.

7. The pneumatic support according to claim 1, wherein the formation has a height above the connection line between the force introduction points delimiting the height of 10 to 15% of the spacing of these force introduction points.

8. The pneumatic support according to claim 1, wherein, when the pneumatic support is under operating pressure but load-free, the side thereof with the compression member is at least partially curved in an arcuate manner, and the side thereof with the tension member is designed such that the force introduction points thereof lie substantially on a straight line.

9. The pneumatic support according to claim 1, wherein the tension member is operatively connected to the pneumatic body only at the location of the force introduction points.

10. A method for producing a pneumatic support according to claim 1, wherein an intended shape of the pneumatic support during operation and a location of the force introduction points are defined and then the curvature to be expected under operating pressure but without operating load is defined, and then formations on the inside of the curve of the pneumatic support are provided, said formations extending outwardly from force introduction point to force introduction point via a connecting line between associated force introduction points.

11. The method according to claim 10, wherein arcuate formations are provided, the height of which is 10 to 15% of the spacing of the associated force introduction points.

12. The method according to claim 10, wherein the pneumatic body of the pneumatic support is brought to operating pressure and checked for the presence of a curvature of the support relative to the intended shape, and in the positive case the height of selected formations is increased by 30-50%.

13. The method according to claim 12, wherein the height of the formations is increased iteratively until a further increase does not produce any further improvement in the curvature of the unloaded support.

* * * * *